US009487977B2

(12) United States Patent
Kreuz

(10) Patent No.: US 9,487,977 B2
(45) **Date of Patent: *Nov. 8, 2016**

(54) SLIDING DOOR ARRESTER

(71) Applicant: FORD GLOBAL TECHNOLOGIES, LLC, Dearborn, MI (US)

(72) Inventor: Thomas Kreuz, Mechernich (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 140 days.

This patent is subject to a terminal disclaimer.

(21) Appl. No.: 14/493,949

(22) Filed: Sep. 23, 2014

(65) Prior Publication Data

US 2015/0008681 A1 Jan. 8, 2015

Related U.S. Application Data

(63) Continuation of application No. 13/572,466, filed on Aug. 10, 2012, now Pat. No. 8,882,159.

(30) Foreign Application Priority Data

Aug. 26, 2011 (DE) ..... 10 2011 081 618

(51) Int. Cl.
*E05C 19/06* (2006.01)
*E05C 17/62* (2006.01)
(Continued)

(52) U.S. Cl.
CPC ..... *E05C 17/62* (2013.01); *E05B 77/02* (2013.01); *E05C 17/60* (2013.01); *E05B 77/12* (2013.01);
(Continued)

(58) Field of Classification Search
CPC ..... E05B 77/02; E05B 77/06; E05B 77/12; E05B 83/04; E05B 83/40; E05B 2015/0458; E05B 17/60; E05B 17/62; E05F 1/16; E05F 5/003; E05F 2003/228; Y10T 292/0894; Y10T 292/0895; Y10T 292/0898; Y10T 292/03; Y10T 292/0899; Y10T 292/14; Y10S 292/22
USPC ..... 292/1, 80, 81, 83, 84, 252, DIG. 22; 16/82; 296/155
See application file for complete search history.

(56) References Cited

U.S. PATENT DOCUMENTS 2,541,858 A * 2/1951 Boehm ..... G06G 1/065 188/67
3,508,720 A * 4/1970 Kell ..... B60R 22/40 242/384.4

(Continued)

FOREIGN PATENT DOCUMENTS

DE 10042282 A1 * 3/2002 ..... B60J 5/0458
DE 10133938 A1 1/2003

(Continued)

*Primary Examiner* — Kristina Fulton
*Assistant Examiner* — Christine M Mills
(74) *Attorney, Agent, or Firm* — Jason C. Rogers; Brooks Kushman P.C.

(57) ABSTRACT

A sliding door for a motor vehicle includes a sliding door arrester to prevent the sliding door from inadvertently closing during a deceleration event. The sliding door arrestor includes a base fixed relative to a guide rail and a locking element pivotally attached to the base. The locking element includes a mass and a lock. The locking element rotates relative to the base during a deceleration event of the vehicle to engage the lock with a biasing member to prevent movement of a sliding element that is displaceable along the guide rail.

19 Claims, 2 Drawing Sheets

(51) Int. Cl.

| | |
|---|---|
| ***E05B 77/02*** | (2014.01) |
| ***E05C 17/60*** | (2006.01) |
| *E05B 77/12* | (2014.01) |
| *E05B 83/40* | (2014.01) |

(52) U.S. Cl.

CPC ..... *E05B 83/40* (2013.01); *Y10S 292/22* (2013.01); *Y10T 29/49826* (2015.01); *Y10T 292/03* (2015.04); *Y10T 292/0894* (2015.04); *Y10T 292/0898* (2015.04)

(56) References Cited

U.S. PATENT DOCUMENTS

| | | | | |
|---|---|---|---|---|
| 4,981,321 | A * | 1/1991 | Watanabe | B60J 5/06 296/155 |
| 5,538,312 | A * | 7/1996 | Lehmkuhl | B60J 5/06 280/853 |
| 5,913,563 | A | 6/1999 | Watanabe et al. | |
| 6,405,485 | B1 * | 6/2002 | Itami | E05B 81/20 49/280 |
| 6,412,222 | B1 | 7/2002 | Hashiba et al. | |
| 6,438,795 | B1 | 8/2002 | Haab et al. | |
| 2003/0009845 | A1 * | 1/2003 | Kindermann | E05C 17/60 16/49 |
| 2005/0206174 | A1 * | 9/2005 | Fisher | E05B 83/36 292/226 |
| 2009/0230700 | A1 * | 9/2009 | Arabia | E05B 77/06 292/93 |
| 2010/0018125 | A1 * | 1/2010 | Oh | E05C 17/60 49/449 |

FOREIGN PATENT DOCUMENTS

| | | | | |
|---|---|---|---|---|
| DE | 10347324 | A1 * | 5/2005 | E05C 17/60 |
| DE | 10130313 | B4 | 7/2011 | |

* cited by examiner

SLIDING DOOR ARRESTER

CROSS-REFERENCE TO RELATED APPLICATIONS

This application is a continuation of U.S. patent application Ser. No. 13/572,466, now U.S. Pat. No. 8,882,159, filed Aug. 10, 2012, which, in turn, claims the benefit of German Patent Application No. DE 102011081618.6 titled "Sliding Door Arrester" filed Aug. 26, 2011, the disclosures of which are hereby incorporated by reference in their entirety.

TECHNICAL FIELD

The present disclosure relates to a door arrester for sliding doors of motor vehicles, which may be moved between a closed position and an open position.

BACKGROUND

Convenient means for locking a vehicle sliding door are desirable.

A door arrester for blocking a sliding door with a latching pawl is disclosed in DE 103 47 324 B4. Said sliding door is mounted in a guide rail on a vehicle and movable between a closed position and an open position. The latching pawl is able to be attached in a region of the guide rail such that it may be brought into engagement with a latching element which is arranged on the sliding door and is displaceable in the guide rail and in the process blocks the sliding door in the region of its open position. The latching pawl is pretensioned by a spring element in the direction of the contact region with the latching element. The spring element is arranged for adjusting the spring force in the contact region with a latching pawl carrier, by the interposition of a support element configured in a torsionally resistant manner on the latching pawl carrier, preferably as a sheet-metal nut, on an adjusting screw for altering the spacing between the ends of the spring element. The adjusting screw may be screwed into the support element and is supported by means of a collar on the side of the latching pawl carrier facing the support element.

Also disclosed in DE 101 33 938 A1 is a door arrester for sliding doors of motor vehicles with a retaining arm that is fastened via a holder to the bodywork that can be pivoted counter to a pretensioned spring. A retaining arm is latched via a latching member to a counter latching member arranged on the sliding door in the open position of the sliding door. A lug is arranged as a latching member on the retaining arm and a latching cam is arranged as a counter latching member that acts transversely to the direction of travel of the sliding door.

There is a problem, however, when a vehicle with an open sliding door starts to move forward and then brakes with the use of the known arresters. The sliding door may be released and closed and/or slammed shut on its own accord in an unrestrained manner.

A device for hooking a door into an opening of a vehicle with a closing bolt and a receiver is disclosed in DE 100 42 282 B4. In this reference the receiver is pivotably mounted and comprises a receiver portion for the closing bolt spaced apart from its pivot axis and at least one closing portion for the closing bolt and a mass. A mass that is spaced apart from a pivot axis after pivoting is brought into a positive connection with the closing bolt. The receiver is fixedly connected to the further mass which is arranged spaced apart from the pivot axis, and the further mass pivots the receiver due to its inertial force. Thus the pivotable vehicle door is hooked onto the bodywork via the normal door lock in the event of an accident or side impact and the forces are introduced into the bodywork.

Therefore, it is desirable to provide a sliding door arrester which prevents automatic closure of the sliding door during braking.

SUMMARY

The present disclosure teaches a sliding door arrester which prevents automatic closure of the sliding door during braking. Such sliding door arresters have proven advantageous as they are simple to construct and to fasten. In addition, such arresters permit easy actuation by a user despite the sliding door being arrested.

In one embodiment, a sliding door mechanism for a vehicle includes a roller attached to a sliding door and a latching a cam biased to engage the roller and configured to deflect upon contact with the roller. The sliding door mechanism further includes a locking element stationary with respect to the vehicle. The locking element includes an inertia lock rotatable to engage the latching cam preventing deflection of the latching cam and displacement of the roller during deceleration of the vehicle.

In another embodiment, a sliding door mechanism for a vehicle includes a sliding element displaceable along a guide rail and a biasing member biased to engage the sliding element to normally prevent displacement along the guide rail and wherein the biasing member deflects upon application of a force greater than a predetermined force to allow displacement of the sliding element along the guide rail. The sliding door mechanism further includes a locking element having a base fixed relative to the guide rail and a shaft pivotally attached to the base. The shaft includes a mass and a lock. The shaft rotates relative to the base during a deceleration event of the vehicle to engage the lock with the biasing member to prevent displacement of the sliding element.

In yet another embodiment, a sliding door mechanism for a vehicle includes a bracket fixed relative to a guide rail and a shaft pivotally attached to the bracket. The shaft includes a mass and a lock. The shaft rotates relative to the bracket during deceleration of the vehicle to engage the lock with a biasing member to prevent deflection of the biasing member relative to the guide rail preventing movement of a sliding element along the guide rail.

BRIEF DESCRIPTION OF THE DRAWINGS

Further details, features and advantages of the invention are revealed from the following description of an exemplary embodiment with reference to the drawing, in which.

DETAILED DESCRIPTION

Figure 1:
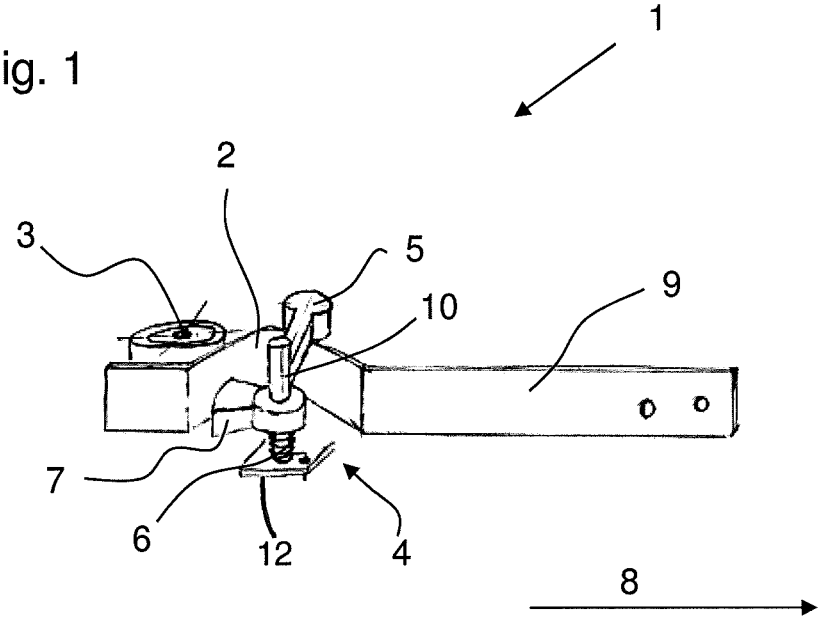
FIG. 1 shows a schematic perspective view of a door arrester for sliding doors of motor vehicles in a resting position.
Figure 2:
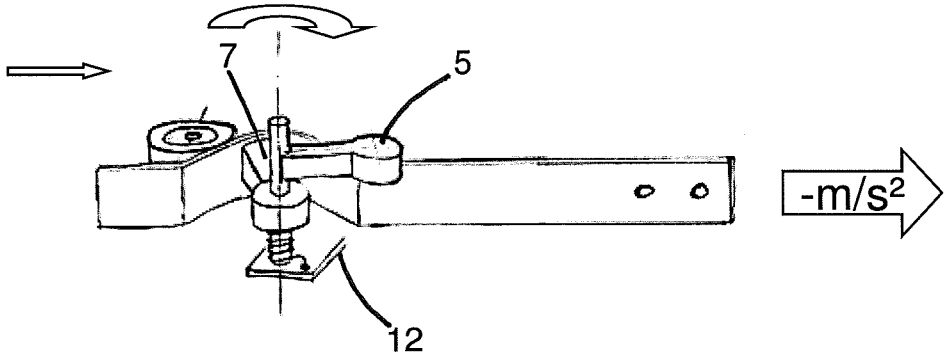
FIG. 2 shows a schematic, perspective view of the door arrester of FIG. 1 when a vehicle is braking.
Figure 3:
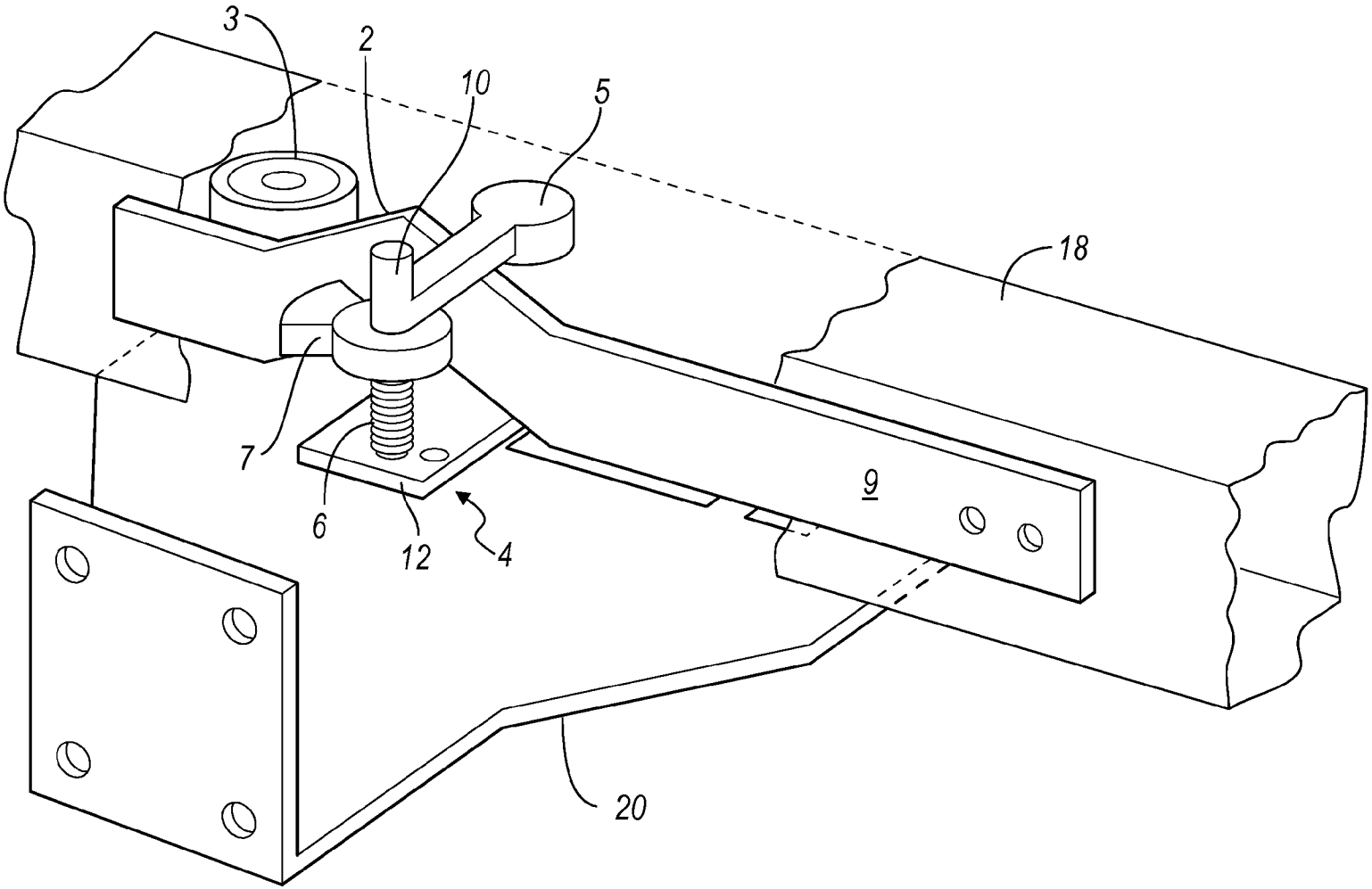
FIG. 3 is a schematic, perspective view of the door arrester and the guide rail.

Referring now to FIGS. 1, 2 and 3, a door arrester for sliding doors of motor vehicles, denoted as a whole by 1, is shown in the figures.

Door arrester 1 comprises a latching cam 2 that may be brought into engagement with a roller 3. The roller is arranged on a portion of the sliding door 20 and is displaceable in a guide rail 18. The latching cam 2 acts as a latching element for blocking the sliding door in an open position, as shown in FIG. 1. In this case, the roller 3 bears against one side of the latching cam 2.

For closing the sliding door, the latching cam 2 can be overcome by subjecting the door to a force acting in the closing direction (i.e., in the direction of arrow 8, i.e. along the rail). Latching cam 2 is guided by roller 3 to move against a pretensioning produced by a spring element 9 when the latching cam 2 deviates from the position shown in FIG. 1 to the position shown in FIG. 2.

In this case, therefore, the cam 2 deviates to a side, transverse to the closing direction and/or direction of the rail, and the roller 3 is able to roll across the cam 2.

A leaf spring 9 simultaneously forms the latching cam 2 in an angled portion of the spring.

In order to prevent an open sliding door from slamming shut during braking, the door arrester additionally comprises a locking element 4. Locking element 4 is configured for locking the deviation movement of the latching cam 2 by means of negative acceleration (or braking acceleration). When subject to the braking acceleration locking element is movable between a position of release and a locked position.

To this end, the locking element 4 is configured to be pivotable about a shaft 10, which is aligned transversely (or perpendicularly) to the direction of travel. The shaft 10 is attached to a bracket 12 that is stationary with respect to a body of the vehicle.

In the position of release, as shown in FIG. 1, the locking element 4 is located adjacent to the leaf spring 9 and in the locked position a block-like locking segment 7 of the locking element bears against the cam 2 and thus blocks the deviation thereof.

The locking element 4 is operatively connected to an inertial mass 5 such that during acceleration the inertial mass 5 moves the locking element 4 and/or the locking segment 7 thereof into its locked position, as shown in FIG. 2. The inertial mass 5 is connected to the shaft 10 of the locking element and drives said locking element at a ratio of 1:1 in the illustrated embodiment.

The locking element 4 is further pretensioned by a spring 6 in order to return to the position of release, as shown in FIG. 1. The spring 6 acts on the shaft 10 of the locking element 4 and/or inertial mass 5.

In normal operation, upon contact with the roller 3 the resiliently configured latching cam 2 is able to deviate counter to the inherent spring force so that the sliding door is able to slide the rail in the sliding direction from the open position into the closed position (and vice versa).

If the sliding door is open and is subjected to a negative acceleration, for example by braking of the motor vehicle ("$-m/s^2$" as shown in FIG. 2), the locking element 4 and/or the locking segment 7 is moved, driven by the inertial mass 5 into the locked position. The locking element 4 prevents a deviation of the latching cam 2 so that the roller 3 is not able to overcome the latching cam 2 and is arrested in the rail. If the negative acceleration decreases, the locking element 4 is moved by the restoring spring 6 into the position of release.

The locking element is provided for locking the movement of a latching cam in the sliding door. The locking element is movable by means of a negative acceleration (for example braking acceleration) between the position of release and the locked position. With the present teachings it is possible to prevent the sliding door from slamming shut. By means of the locking element it is now more difficult for the latching element to overcome the latching cam which is stationary.

The latching cam, which would otherwise deviate by contact with the latching element counter to the pretensioning of the spring, is now not able to deviate as the spring is blocked and locks the movement of the latching cam.

The spring, which is in the form of a leaf spring, forms the latching cam at the same time, for example in the form of an angled portion.

For adopting the locked position, the locking element is designed to be pivotable about an axis which is aligned transversely to the direction of travel. Thus, the axis can accordingly be aligned horizontally or vertically.

If in the locked position, the locking element blocks the spring element against deviation of the latching cam.

The locking element is operatively connected to an inertial mass such that during acceleration the inertial mass moves the locking element into its locked position. Thus, in the illustrated embodiment, the locking element acts automatically.

Additionally, if the inertial mass is articulated to the rotational axis of the locking element, at the same time, the locking element may be pretensioned by a spring for returning to the position of release. The spring force of said "restoring spring" is then designed to correspond to the masses of the sliding door and the door arrester.

It is particularly preferred in this case that the spring acts on the rotational axis of the locking element and/or inertial mass.

The latching cam is thus configured in a resilient manner able to deviate against the spring force upon contact with the latching element, which is configured, for example as a roller, so that the sliding door is able to slide in the sliding direction from the open position into the closed position (and vice versa). If the sliding door is opened and subjected to negative acceleration, for example by braking of the motor vehicle, the locking element is then moved, driven by the inertial mass, into the locked position and preventing deviation of the latching cam, so that the latching element is not able to overcome the latching cam. If the negative acceleration decreases, the locking element is moved by the restoring spring into the position of release.

The sliding door is movable between a closed position and an open position along the rail. It is held by the door arrester in the open position.

What is claimed is:

1. A sliding-door assembly for a vehicle comprising:

a sliding-door roller disposed in a rail;

a leaf spring biased to extend into an interior of the rail and deflectable upon contact with the roller; and a locking mechanism including a vertical shaft, a lock, and a weight element that, in response to deceleration of the vehicle, rotates the lock into engagement with the leaf spring preventing deflection of the leaf spring and displacement of the roller.

2. The sliding door assembly of claim 1 wherein the leaf spring further includes a latching cam biased to extend into a movement path of the roller.

3. The sliding door assembly of claim 1 wherein the leaf spring is directly connected to the rail.

4. The sliding door assembly of claim 1 further comprising a bracket stationary with respect to the vehicle, wherein the vertical shaft is connected to the bracket such that the lock is pivotable with respect to the bracket about the vertical shaft.

5. The sliding door assembly of claim 1 wherein the lock and the weight element are each connected to the vertical shaft.

6. The sliding door assembly of claim 5 further comprising a bracket stationary with respect to the vehicle, wherein the vertical shaft is pivotably connected to the bracket.

7. The sliding door assembly of claim 6 further comprising a coil spring connected to the bracket and the shaft, the coil spring biasing the shaft such that the lock is disengaged with the leaf spring.

8. A sliding door mechanism for a vehicle sliding door comprising:

a sliding element displaceable along a guide rail;

a biasing member connected to the guide rail and biased to engage the sliding element to normally prevent displacement along the guide rail, wherein the biasing member deflects upon application of a force greater than a predetermined force to allow displacement of the sliding element along the guide rail; and a locking assembly including a base fixed relative to the guide rail and a vertical shaft pivotally attached to the base, the shaft including a weight element horizontally offset from the shaft and a lock horizontally offset from the shaft, wherein the weight element is offset from the shaft such that, in response to deceleration of the vehicle, the shaft rotates relative to the base to engage the lock with the biasing member to prevent displacement of the sliding element in a door closing direction.

9. The sliding door mechanism of claim 8 wherein the locking assembly further includes a spring attached to the base and the shaft, and biased such that the lock is disengaged with the biasing member.

10. The sliding door mechanism of claim 8 wherein the biasing member is a leaf spring.

11. The sliding door mechanism of claim 8 wherein the weight element and the lock are fixed relative to each other.

12. The sliding door mechanism of claim 8 wherein the sliding element is a roller.

13. The sliding door mechanism of claim 8 wherein the biasing member further includes a latching cam extending into the guide rail and into a movement path of the sliding element.

14. A vehicle sliding door assembly comprising:

a sliding door including a roller movable along a guide rail in a door opening direction and a door closing direction;

a latching cam disposed within the guide rail and engageable with the roller;

a bracket fixed relative to the guide rail; and a vertical shaft pivotally attached to the bracket and including a lock, and a weight element that, in response to deceleration of the vehicle, rotates the lock into engagement with the latching cam preventing movement of the roller along the guide rail in the door closing direction.

15. The vehicle sliding door of claim 14 wherein the latching cam is formed on a leaf spring that is attached to the guide rail.

16. The vehicle sliding door claim 14 wherein the weight element and the lock have fixed positions relative to each other.

17. The vehicle sliding door of claim 14 wherein the roller is a wheel.

18. The vehicle sliding door of claim 14 wherein the latching cam is biased to engage the roller to normally prevent displacement along the guide rail in the door closing direction, wherein the biasing member is deflectable upon an application of a force greater than a predetermined force to allow displacement of the roller along the guide rail in the door closing direction.

19. The vehicle sliding door of claim 14 further comprising a second spring connected to the shaft and the bracket to bias the lock such that the lock is disengaged with the latching cam.

* * * * *